US007058324B2

(12) United States Patent
Shibuya et al.

(10) Patent No.: US 7,058,324 B2
(45) Date of Patent: Jun. 6, 2006

(54) IMAGE FORMING APPARATUS HAVING AN IMAGE BEARING MEMBER WITH VARIED GLOSSINESS

(75) Inventors: Takashi Shibuya, Shizuoka (JP); Tatsuya Kobayashi, Shizuoka (JP); Masaru Shimura, Shizuoka (JP); Seiji Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 10/720,237

(22) Filed: Nov. 25, 2003

(65) Prior Publication Data

US 2004/0161253 A1 Aug. 19, 2004

(30) Foreign Application Priority Data

Nov. 29, 2002 (JP) ..... 2002-348355
Nov. 21, 2003 (JP) ..... 2003-393072

(51) Int. Cl.
*G03G 15/00* (2006.01)

(52) U.S. Cl. ..... 399/49

(58) Field of Classification Search ..... 399/49, 399/159, 162, 302, 303, 308, 312, 313
See application file for complete search history.

(56) References Cited

U.S. PATENT DOCUMENTS 5,256,621 A * 10/1993 Yasuda et al. ..... 503/227

FOREIGN PATENT DOCUMENTS

JP 2002351269 A * 12/2002
JP 2003107922 A * 4/2003

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus an image bearing member adapted to bear a toner image and having a first glossiness in a first direction and a second glossiness lower than said first glossiness, and an optical detection unit including a light-emitting unit and a light-receiving unit, wherein a light emitted by the light-emitting unit is reflected by the image bearing member and is received by the light-receiving means and an optical direction from the light-emitting means to the light-receiving means is substantially same as the first direction of the image bearing member.

9 Claims, 8 Drawing Sheets

IMAGE FORMING APPARATUS HAVING AN IMAGE BEARING MEMBER WITH VARIED GLOSSINESS

BACKGROUND OF THE INVENTION

1. Field of the Invention

The present invention relates to an image forming apparatus such as a copying machine or a laser beam printer, and more particularly to an image forming apparatus capable of detecting a light from a surface of an image bearing member.

2. Related Background Art

In an image forming apparatus utilizing an electrophotographic image forming process, apparatus of various types are recently being proposed and commercialized. FIG. 10 shows a background technology of the present invention and is a schematic cross-sectional view of a multi-color image forming apparatus.

A photosensitive member unit including a first image bearing member integrally includes a charging member 2 and a cleaning member 9 along a periphery of a drum-shaped photosensitive member 1 constituting the first image bearing member.

An exposure apparatus provided above the photosensitive member unit forms an electrostatic latent image based on image data, on the photosensitive member 1 charged to a predetermined potential by the charging member 2.

A developing apparatus 40 develops the electrostatic latent image, formed on the surface of the photosensitive member 1, with a developer thereby obtaining a developed image. In the image forming apparatus shown in FIG. 10, the developing apparatus 40 is constituted of units of four colors (yellow 4Y, magenta 4M, cyan 4C and black 4K) for forming a multi-color image.

An intermediate transfer unit including a second image bearing member includes an intermediate transfer belt 105 constituting a second image bearing member and so provided as to oppose to the photosensitive member 1 in a position downstream of a contact portion with the developing apparatus 40 in the rotating direction of the photosensitive member 1. Along an internal periphery of the intermediate transfer belt 105, there are provided a first transfer member 54 (roller) and plural rollers 51, 52, 53 for supporting the belt 105. Developed images of respective colors, formed on the photosensitive member 1 constituting the first image bearing member, by the developing apparatus 4M, 4C, 4Y, 4K are transferred in succession and in superposition on the intermediate transfer belt 105 constituting the second image bearing member, whereby the belt 105 bears a multi-color image constituting a basis of a final image.

A transfer apparatus 6 is constituted of a roller-shaped elastic member, and transfers the developed image, on the intermediate transfer belt 105 constituting the second image bearing member, onto a transfer material P supplied at a predetermined timing from a sheet feeding unit 12.

A fixing apparatus 8 is constituted of pressure members 83, 84 incorporating heat sources 81, 82 and fixes the developed image, on the transfer material P, to the transfer material P under application of heat and a pressure, thereby obtaining a multi-color image.

After the transfer step to the intermediate transfer belt 105, toner remaining on the photosensitive member 1 is recovered by a cleaning member 9, while toner remaining on the intermediate transfer belt 105 is recovered by a cleaning member 10 in preparation for a next image formation.

As a multi-color image forming apparatus, in addition to the configuration shown in FIG. 10, there is also known an image forming apparatus of so-called tandem system in which four image forming units, each integrally including a first image bearing member and a developing apparatus, are arranged parallel to an intermediate transfer belt constituting a second image bearing member and execute image formations of respective colors substantially simultaneously thereby improving an image forming efficiency.

In any multi-color image forming apparatus, there has been a remarkable improvement in image quality in recent years, and a higher image quality and a higher stability are desired by the user.

A higher image quality means an image output without a deterioration a color reproduction or an image texture, in comparison with an original image. On the other hand, a higher stability means to constantly reproduce a same image quality in the output image under any environment.

Parameters that may deteriorate such high image quality and stability include environmental characteristics and a deterioration in time of the photosensitive member and the developer.

The multi-color image forming apparatus often employs a control for correcting such changes in the photosensitive member and the developer. For example, the apparatus shown in FIG. 10 employs, for such correction control, a control process of forming a predetermined test pattern on the image bearing member, detecting a density of the test pattern with optical detection means 311 and correcting a charging condition, an exposing condition or a developing condition based on a result of such detection.

In case of executing a density detection of a test pattern on the intermediate transfer belt, a high surface glossiness is required for the intermediate transfer belt. This is because the optical detection means adopts, as a detecting principle for detecting a toner density of the test pattern formed on the intermediate transfer belt, a method of detecting a light amount reflected from the intermediate transfer belt corresponding to the toner density, namely by receiving a reflected light with light-receiving means based on a light emitting from light-emitting means, so that a higher surface glossiness is required for the intermediate transfer belt in order to measure the optical intensity of the received light and to exactly and precisely detect the toner density.

As explained above, in detecting the toner density of the test pattern formed on the intermediate transfer belt, a larger reflected light amount from the belt increases a dynamic range, thereby improving a precision of detection.

Thus, in case of executing an optical detection by measuring the optical intensity of the reflected light from the belt surface and controlling image forming conditions such as an image density control based on such detection, a limited amount of the reflected light from the belt results in an inferior detecting precision, leading to a decrease in the density whereby a high image quality cannot be maintained.

SUMMARY OF THE INVENTION

An object of the present invention is to provide an image forming apparatus capable of improving a precision of detection of a toner density, thereby forming an image of a high quality.

Another object of the present invention is to provide an image forming apparatus including an image bearing member for bearing a toner image, optical detection means having light-emitting means and light-receiving means, wherein the image bearing member has a first glossiness in a first direction and a second glossiness in a second direction lower than the first glossiness, a light emitted from the light-emitting means is reflected by the image bearing member and is received by the light-receiving means, and an optical direction from the light-emitting means to the light-receiving means is substantially same as the first direction of the image bearing member.

Another object of the present invention is to provide an image forming apparatus including a belt for bearing a toner image, and optical detection means having light-emitting means and light-receiving means, wherein the belt at a manufacture thereof is drawn from a mold, a light emitted from the light-emitting means is reflected by the image bearing member and is received by the light-receiving means, and an optical direction from the light-emitting means to the light-receiving means is substantially same as a drawing direction of the belt.

Still other objects of the invention will become fully apparent from a following description.

DESCRIPTION OF THE PREFERRED EMBODIMENTS

In the following, an image forming apparatus constituting an embodiment of the present invention will be explained with reference to accompanying drawings.

Figure 1:
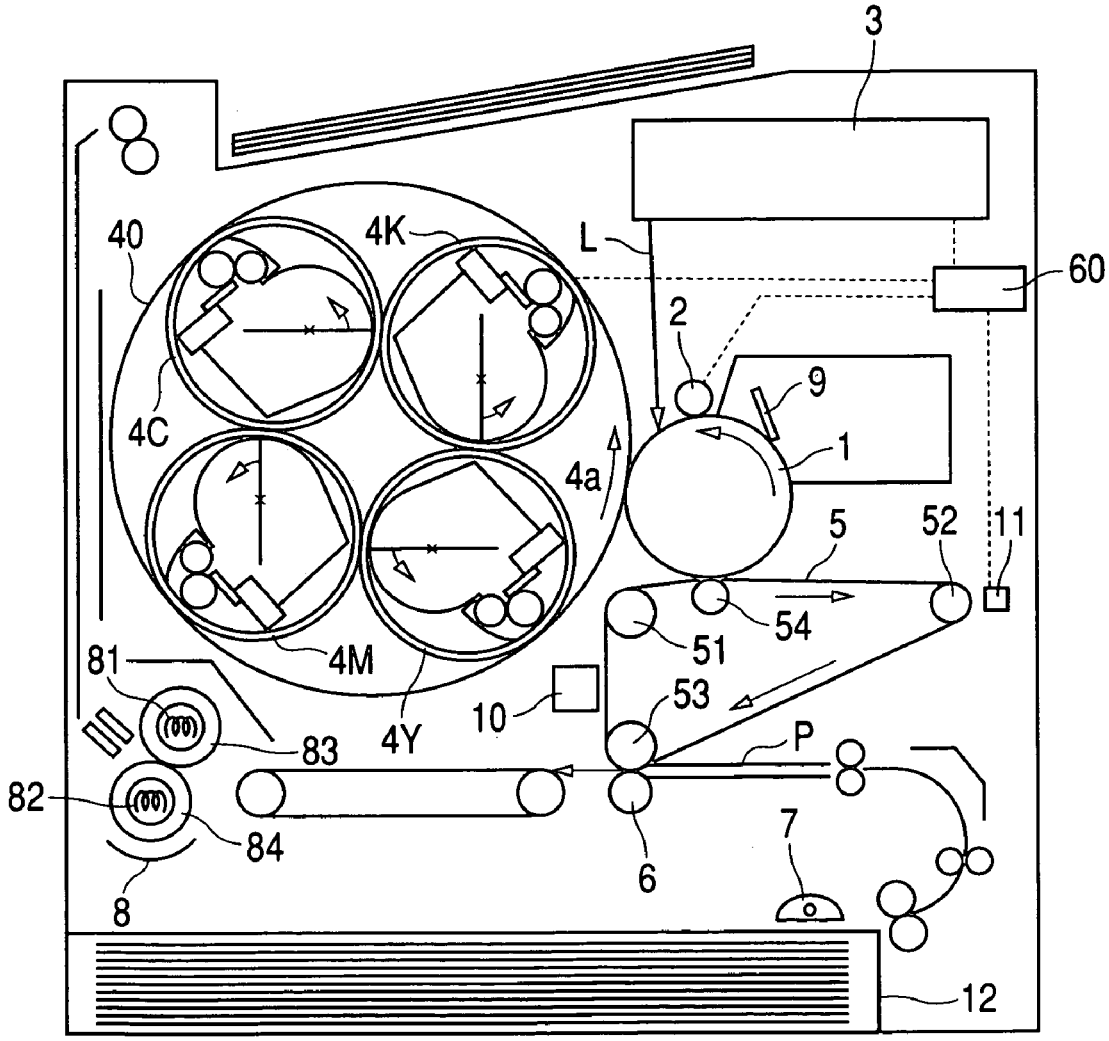
FIG. 1 is a schematic view showing a configuration of an image forming apparatus constituting an embodiment of the present invention.

Following description will be made with reference to a schematic cross-sectional view in FIG. 1, showing a multi-color image forming apparatus utilizing an electrophotographic process which is a basis of the present invention.

The multi-color image forming apparatus shown in FIG. 1 is a laser beam printer utilizing an electrophotographic process, and is a color laser beam printer constituted of a first image bearing member (photosensitive drum), a second image bearing member (belt-shaped intermediate transfer member), and plural development units (cartridges including developers of yellow, magenta, cyan and black).

In the following, the multi-color image forming apparatus of the present invention will be explained on configurations of various parts thereof and functions thereof along image forming steps.

As a first image bearing member, an electrophotographic photosensitive member 1 of rotary drum-shape (hereinafter called "photosensitive drum 1") is provided in a main body of the apparatus. A surface of the photosensitive drum 1 is uniformly charged to a predetermined potential by a charging apparatus 2. The uniformly charged photosensitive drum 1 is subjected to an irradiation by a laser light L emitted from an exposure apparatus 3 based on an image signal, whereby an electrostatic latent image based on the image signal is formed on the photosensitive drum 1.

When the electrostatic latent image formed on the periphery of the photosensitive drum 1 passes at a predetermined timing, by a rotation of the photosensitive drum 1, a developing device 4Y (hereinafter called "developing cartridge 4Y") positioned at a predetermined gap to the photosensitive drum 1, the developing cartridge 4Y is given a bias for enabling a development of the electrostatic latent image with a desired amount of developer (toner), whereby the electrostatic latent image is rendered visible (developed) as a developed image (toner image) by the developing cartridge 4Y.

A visible toner image on the photosensitive drum 1 is transferred onto a surface of the intermediate transfer member 5 constituting a second image bearing member which is in contact by a predetermined contact width with the photosensitive drum 1 and which moves, in such contact portion, in a direction same as that of the photosensitive drum 1 (namely overall rotating directions being mutually opposite) and with a speed approximately same as that of the photosensitive drum 1, under an application of a transfer bias to a primary transfer member 54 provided inside the intermediate transfer member 5.

The above-explained step is executed similarly for the developing cartridges 4M, 4C and 4K of other colors, whereby, after a completion of all the steps, unfixed toner images constituted of yellow, magenta, cyan and black toners are formed in superposition on the intermediate transfer member 5. The developing apparatus (developing unit) 4 rotates in a direction indicated by an arrow 4*a*.

In synchronization with a timing when the unfixed toner image on the intermediate transfer member 5 approaches a secondary transfer member 6, a transfer material P constituting a recording material is fed by a feed roller 7 and is conveyed to a contact portion between the intermediate transfer member 5 and the secondary transfer member 6. In passing the contact portion, a predetermined bias is applied to the secondary transfer member 6 whereby the unfixed toner image on the intermediate transfer member 5 is transferred onto the transfer material P.

The transfer material P bearing the transferred unfixed toner image is conveyed to a fixing apparatus 8 and is subjected to a heat and a pressure therein whereby a fixing to the transfer material P is achieved to complete formation of a desired multi-color image.

Toner remaining on the photosensitive drum 1 after the transfer step to the intermediate transfer member 5 is cleaned by a cleaning member 9 for the photosensitive drum 1, whereby it is prepared for a next image forming process.

Also toner remaining on the intermediate transfer member 5 after the toner image transfer step to the transfer material P by the secondary transfer member 6 is cleaned by a cleaning apparatus 10 which is brought into contact with the intermediate transfer belt 5 by unrepresented biasing means at a predetermined timing, whereby the intermediate transfer member is prepared for a next image forming process.

The intermediate transfer member 5 is an endless-shaped seamless belt based on an acrylonitrile-butadiene-styrene (ABS) resin of a thickness of 80 μgm, a peripheral length of 440 mm and a width of 245 mm. The belt is adjusted to a volumic resistance of $10^8$ to $10^{10}$ Ω·cm by molding with a dispersion of a conductive material as an electrical resistance regulating agent.

A primary transfer member 54 is provided in a position opposed to the photosensitive member 1, across the intermediate transfer belt 5, constituting the intermediate transfer member. The primary transfer member 54 is a roller for applying a transfer bias necessary for transferring the toner image on the photosensitive drum 1 onto the intermediate transfer belt 5.

The primary transfer member 54 is a roller-shaped member constituted of a foamed elastic member (with a metal core of a diameter of 6 mm) of an external diameter of 14 mm of which a volumic resistivitiy is adjusted to $10^5$ to $10^9$ Ω·cm, and is given a bias of 0.2 to 4 kV at the transfer of the toner image from the photosensitive drum 1 to the intermediate transfer belt 5. The elastic layer has an ASKER-C hardness (JIS-A) of 20 to 40°.

The secondary transfer member 6 is provided in a position opposed, across the intermediate transfer belt 5, to a roller 53 supporting the intermediate transfer belt 5, and supports the transfer material P in cooperation with the intermediate transfer belt 5. The secondary transfer member 6 is a roller for applying a transfer bias necessary for transferring the color toner image, formed on the surface of the intermediate transfer belt 5, onto the transfer material P.

The secondary transfer member 6, like the primary transfer member 54, is a roller-shaped member constituted of a foamed elastic member (with a metal core of a diameter of 6 mm) of an external diameter of 18 mm of which a volumic resistivitiy is adjusted to $10^5$ to $10^9$ Ω·cm, and is given a bias of 0.2 to 4 kV at the transfer of the toner image from the intermediate transfer belt 5 to the transfer material P. The elastic layer has an ASKER-C hardness (JIS-A) of 20 to 40°. Rollers 51, 52 are tension rollers for supporting the belt 5 under a tension. Thus, the rollers 51, 52 and 53 constitute support rollers for supporting the belt.

The fixing apparatus 8 is constituted of a pair rollers 83, 84 of an external diameter of 40 mm formed by silicone rubber, which are heat controlled at 180° C. by heaters 81, 82 provided inside the rollers.

In order to stably maintain an image formation of a high image quality even in the presence of a variation in the photosensitive member or the developer by environmental parameters or by the lapse of time, the image forming apparatus of the present embodiment executes a control of forming a predetermined developed image (test pattern) for density detection on the image bearing member, then detecting a density of such image and correcting a charging condition, an exposing condition or a developing condition according to the result of such detection. In the present embodiment, the test pattern is formed on the intermediate transfer member 5 constituting the second image bearing member.

In the following there will be explained a correction control by such density detection.

In a predetermined position opposed to the intermediate transfer member 5, optical detection means (optical sensor) 11, to be explained later in more details, is provided for such correction control, and the main body of the image forming apparatus is provided with control means 60 (adjustment means for image forming conditions) including means for optimizing image forming conditions.

Also at the density detection of a toner image formed on the intermediate transfer member 5, an electrostatic latent image for density detection, constituting a reference latent image for density correction, is formed on the photosensitive drum 1, outside an image forming area on the photosensitive drum 1, by an irradiation of optical information based on a predetermined signal generated by electrostatic latent image forming means for density detection in a control unit (control means 60) of the main body of the apparatus, and such electrostatic latent image for density detection is rendered visible by the developing apparatus 40 to form a density detecting developed image of a predetermined image (predetermined test pattern), for example a stripe-shaped toner image.

Such density detecting developed image (density detecting toner image) on the photosensitive drum 1 is transferred onto the intermediate transfer member 5. The optical sensor 11 opposed to the intermediate transfer member 5 detects an image formation state, on the intermediate transfer member 5, of the test pattern formed by the developing apparatus 40 outside the image forming area of the photosensitive drum 1, namely an image density representing a toner amount constituting the test pattern.

Based on a result of image density detection of the test pattern by the optical sensor 11, the control means 60 in the image forming apparatus regulates an image forming condition such as a charging condition, an exposing condition, a developing condition etc. on the photosensitive drum 1.

Figure 2:
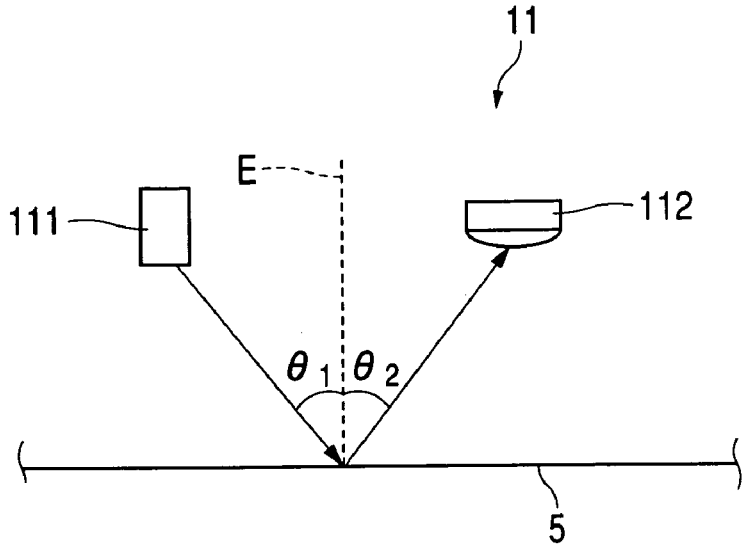
FIG. 2 is a schematic view showing a configuration of optical detection means.

FIG. 2 is a schematic cross-sectional view of the optical sensor 11. The optical sensor 11 is provided in a position outside the periphery of the intermediate transfer belt 5 in such a manner that a plane of the sensor 11 can be maintained parallel to the surface of the intermediate transfer belt 5. The optical sensor 11, being of a normal reflection type, is constituted of a light-emitting diode (LED) 111 as light-emitting means and a photodiode (PD) 112 as light-receiving means, each being positioned symmetrically, with a same angle α, to a normal line to the intermediate transfer belt 5. Thus, in the optical sensor 11, an incident angle θ1 and an exit angle θ2 with respect to the intermediate transfer belt 5 is a same angle α.

In the optical sensor 11, the light-emitting means 11 and the light-receiving means 12 have a sensitivity in a wavelength (about 960 nm) in the infrared region, and an optical reflectance of the intermediate transfer belt 5 means a reflectance in the infrared region.

In the following, an optical direction of the optical detection means relating to a feature of the present invention means a direction formed by the light-emitting means 111 and the light-receiving means 112, and also means a direction from the light-emitting means 111 to the light-receiving means 112.

Now there will be explained a concept of detecting the toner density of a test pattern T by the optical detection means 11.

In the optical detection means 11 of normal reflection type, a reflected light amount corresponding to the test pattern T from the belt 5 bearing the test pattern T is correlated with a toner density.

Figure 3:
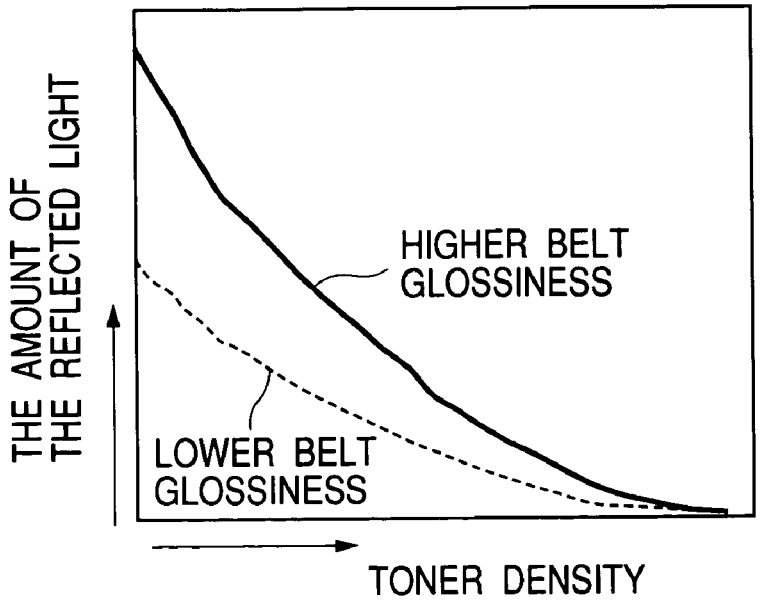
FIG. 3 is a chart showing a relationship between a light amount reflected from an intermediate transfer belt and a developed density.

FIG. 3 is a chart showing a correlation between the toner density of the test pattern and the light amount received by the optical detection means 11.

As explained in the foregoing, the optical detection means 11 of normal reflection type detects a reflected light from the belt 5 bearing the test pattern T, so that a received light amount decreases with an increase in the toner density of the test pattern T, resulting in an increase in a covering rate of the belt surface, whereby a relationship higher at the left-hand side (or lower at the right-hand side) in a chart indicating the reflected light amount in the ordinate and the toner density in the abscissa as shown in FIG. 3.

It is therefore very important to maintain a larger light reception amount in a so-called initial state where the test pattern T is not formed on the belt 5. A larger light reception amount allows to secure a larger range of variation (dynamic range) of the light reception amount vis-à-vis the toner density, thereby improving the precision of detection. On the other hand, in case of a lower belt glossiness as indicated by a broken line in FIG. 3, the dynamic range becomes smaller because of a lower light reception amount in the initial state, thereby lowering the precision of detection.

Therefore, in case of employing an optical detection element of normal reflection type, constituted of light-emitting means 111 and light-receiving means 112 as the optical detection means, it is desired that the intermediate transfer belt 5 has a higher surface glossiness.

On the other hand, for producing the intermediate transfer belt 5, there can be utilized a method of supplying a resinous material between a pair of pressing rolls to obtain a sheet with regulated thickness and width, and adjoining such sheet to obtain a cylindrical belt. In such rolling method, an anisotropy in glossiness depending on the rolling direction can be arbitrarily adjusted in direction by an adjoining position of such cylindrical belt.

However, in consideration of facts that such method requires an adjoining step and an image formation cannot be executed at the adjoining part of such belt, a following producing method is more productive and enables an efficient image formation.

FIGS. 4A to 4D schematically shows a flow of producing steps of such method for producing the intermediate transfer belt 5.

Figure 4A:
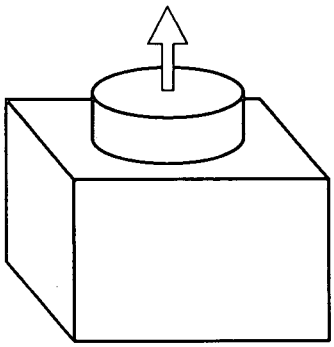
FIGS. 4A, 4B, 4C and 4D are schematic views showing a method for forming the intermediate transfer belt.
Figure 4B:
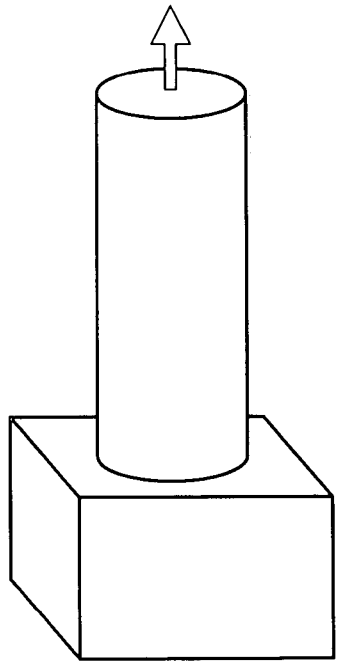
Figure 4C:
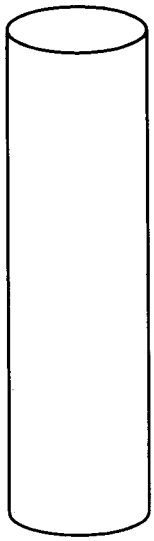
Figure 4D:
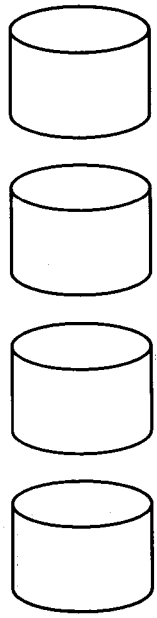

In order to improve the productivity, the intermediate transfer belt 5, constituting the second image bearing member, is produced by a continuous drawing in a cylindrical form from a mold in a production apparatus controlled at a constant thickness, thereby obtaining a belt in a state shown in FIG. 4C from states shown in FIGS. 4A and 4B, and cutting such belt into a predetermined final width (longitudinal width).

In such operation, since an orientation of a crystalline structure constituting the intermediate transfer belt 5 is controlled at the drawing direction, there is generated a difference in glossiness, resulting from a difference in the orientation of the crystalline structure, between a moving direction of the intermediate transfer belt 5 in the image forming apparatus and a direction crossing thereto, namely an anisotropy in the glossiness of the intermediate transfer belt 5. Because the belt 5 has a cylindrical shape, the moving direction of the intermediate transfer belt 5 in the image forming apparatus means a circumferential direction thereof, and the crossing direction means an axial direction of the cylindrical shape.

Figure 5:
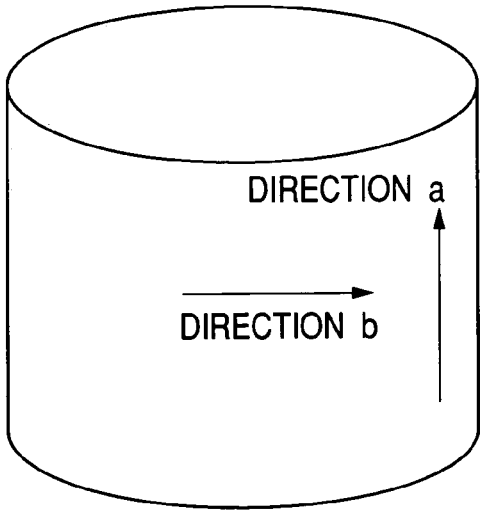
FIG. 5 is a schematic view showing an anisotropy of the intermediate transfer belt.

FIG. 5 shows measuring direction in case of measuring an anisotropy in the glossiness of the belt, for a resinous (ABS) belt employed in the present embodiment. A direction a, constituting a first direction coincides with a belt drawing direction at the manufacture of the belt, and is perpendicular to the moving direction of the belt 5 in the image forming apparatus. A direction b, constituting a second direction, is a circumferential direction of the belt and coincides with the moving direction of the belt 5 in the image forming apparatus.

Figure 6:
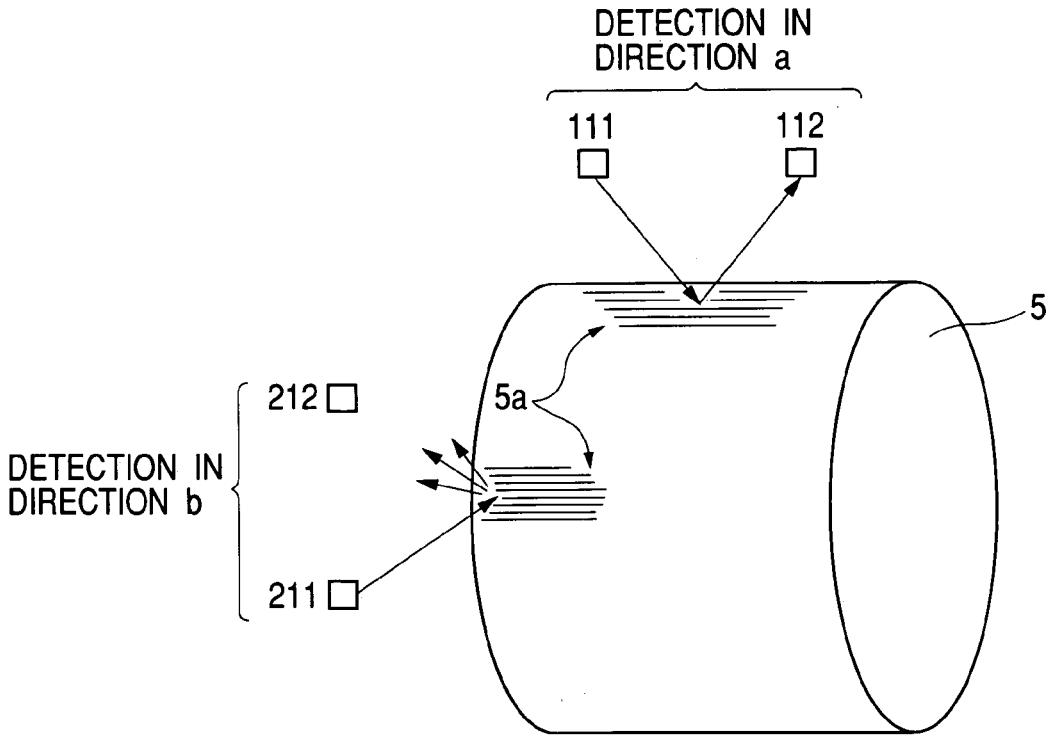
FIG. 6 is a view showing a difference in a reflected light amount based on the anisotropy of the intermediate transfer belt.
Figure 7:
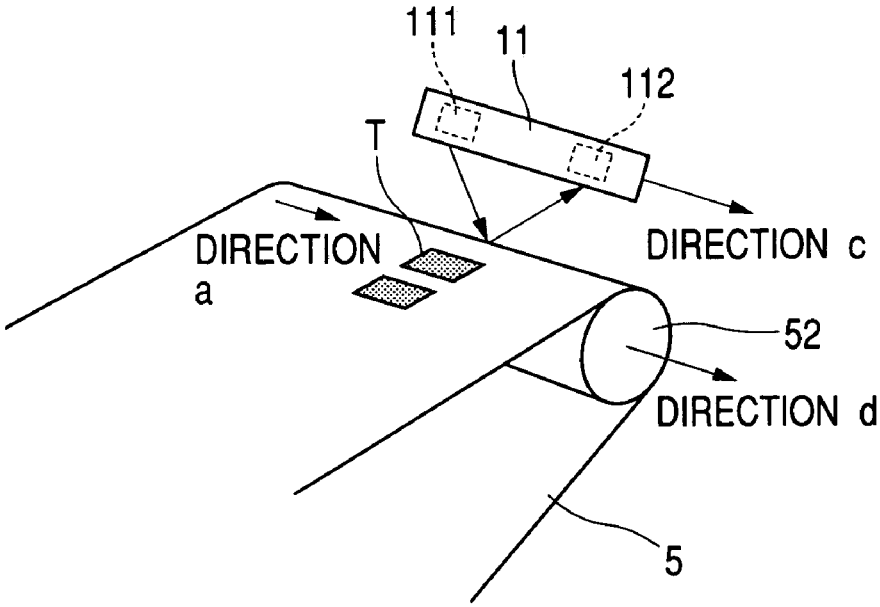
FIG. 7 is a schematic view showing a density detecting method of optical detection means.

Glossiness of the belt in the direction a and the direction b were measured, as shown in FIG. 6, with a measuring instrument (product name; IG-320, manufactured by Horiba Co.).

As a result, the glossiness was 50% in the direction a and 40% in the direction b, each as an average value of several locations. Thus, the glossiness in the first direction is higher than that in the second direction. The glossiness used herein is represented by a percentage of a light reception amount of the light-receiving means 112, 212 with respect to a light emission amount emitted from the light-emitting means 111, 211.

In case of a detection in the direction a, the optical direction from the light-emitting means 111 to the light-receiving means 112 is substantially same as a direction of orientation 5*a* of the crystalline structure of the belt 5, so that the light emitted from the light-emitting means 111 reaches the light-receiving means 112 without much random reflection by the orientation 5*a* of the crystalline structure, so that the light-receiving means 112 receives a relatively large light amount. On the other hand, in case of a detection in the direction b, the optical direction from the light-emitting means 111 to the light-receiving means 112 is substantially perpendicular to the direction of orientation 5*a* of the crystalline structure of the belt 5, so that the light emitted from the light-emitting means 111 is randomly reflected by the orientation 5*a* of the crystalline structure, so that the light-receiving means 112 receives a relatively small light amount.

In case of placing the optical direction of the optical detection means of normal reflection type in the direction a or the direction b on such belt, the precision of detection of the toner density of the test pattern T formed on the intermediate transfer belt 5 was higher, as explained in the foregoing, when the light-emitting means 111 and the light-receiving means 112 were aligned along the direction a with a higher glossiness of the belt, namely along the direction perpendicular to the moving direction of the belt 5.

Foregoing results confirmed, in a multi-color image forming apparatus in which an image bearing member for bearing a test pattern has an anisotropy in the surface glossiness and in case the optical detection means for detecting the toner density of the test pattern on such image bearing member is an optical sensor of normal reflection type, that the precision of detection of the toner density could be improved by matching the optical direction of such sensor with a direction with a higher surface glossiness of the image bearing member.

Therefore, in the present embodiment, the optical direction c of the optical detection means 11 is made substantially same as a direction perpendicular to the moving direction of the belt 5 (namely axial direction d of the tension roller 52).

In this manner, the present embodiment can improve the precision of detection of the test patterns thereby enabling formation image formation with a high image quality.

The tension roller 52 has a higher precision of the external shape in order to stabilize conveying of the intermediate transfer belt 5. Therefore, a positional precision of the optical detection means 11 relative to the tension roller 52 can be further improved by providing the optical detection means 11 in a position opposed to the optical detection means 11.

As a result of such opposed positioning to the tension roller 52, there can also be improved a positional precision to the intermediate transfer belt 5 supported by the tension roller 52, thereby reducing a fluctuation in the precision of toner density detection, resulting from a positional factor.

Also since the optical direction c of the optical detection means coincides with the direction of higher glossiness of the belt, namely with the axial direction d of the tension roller 52 in this case, there can also be obtained an advantage that the positional precision relative to the intermediate transfer belt 5 becomes equal to the positional precision in the axial direction of the tension roller 52.

As explained in the foregoing, in an image forming apparatus employing an intermediate transfer belt having an anisotropy in the surface glossiness, in case of detecting the toner density of the test pattern formed on the intermediate transfer belt by optical detection means, it is rendered possible to most efficiently receive the reflected light from the belt by positioning the direction of the higher surface glossiness of the intermediate transfer belt so as to coincide with the optical direction of the optical detection means and by positioning the optical detection means so as to be opposed to the intermediate transfer belt, and the positional precision of the belt and the optical detection means is improved by positioning the tension roller and the optical detection means in the mutually opposed relationship, whereby it is rendered possible to improve the precision of detection of the toner density in the test pattern formed on the intermediate transfer belt. Also the opposed positioning of the tension roller of the intermediate transfer belt and the optical detection means can provide a certain effect even in case a direction showing a higher surface glossiness of the intermediate transfer belt is in another direction (for example in the moving direction of the belt) as long as it coincides with the optical direction of the optical detection means, but a particularly excellent effect can be obtained in case the optical direction of the optical detection means, the direction of higher surface glossiness and the axial direction of the tension roller are same.

The present embodiment has been explained in a case where the intermediate transfer belt constituting the second image bearing member is formed by an ABS resin, but the present invention is naturally not limited to the ABS resin and can provide a similar effect on a belt of any material, showing an anisotropy in the surface glossiness.

In the following, there will be explained another embodiment of the present invention. This embodiment shows an effect of the present invention on optical detection means, which is used for a purpose other than the density detection means explained in the foregoing embodiment.

The optical detection means in the present embodiment constitutes a part of control means for controlling timings of image formations of respective colors, and, as in the optical detection means explained in the foregoing embodiment, executes a detection and a control according to a change in a reflected light amount from an intermediate transfer belt constituting the second image bearing member.

More specifically, the optical detection means in the present embodiment serves as control means for synchronizing timings of image formations of respective colors, in such a manner that images of respective colors are formed in a proper position on the intermediate transfer belt.

Optical detection means 411 of the present embodiment has a configuration similar to that of the optical detection means 11 of the foregoing embodiment as shown in FIG. 2, and constructed as a normal reflection type.

Figure 8:
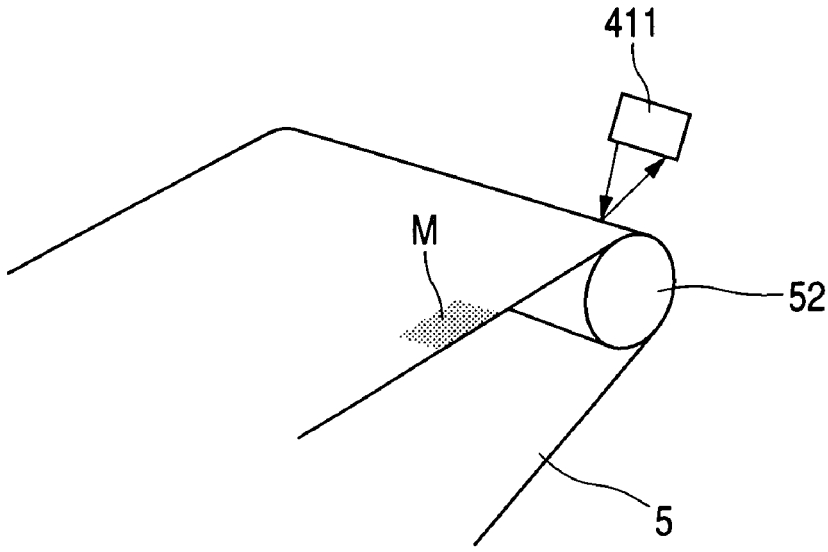
FIG. 8 is a schematic view showing a position detecting method for a marking by the optical detection means.

In the present embodiment, at an end of the intermediate transfer belt 5 in a direction crossing the moving direction thereof, there is provided, as shown in FIG. 8, a marking M of about a width of 10 mm and a length of 20 mm for each image forming area.

In the present embodiment, the marking M is required to have characteristics not reflecting, as far as possible, an irradiating light emitted from the optical detection means 411. Physical properties meeting such characteristics are a black color and a surface glossiness within a range of 0 to 10%. A black color provides a spectral reflectance in the infrared region not exceeding 10%. Also a surface glossiness within a range of 0 to 10% can be securely realized by roughing the surface of the marking M.

In case the entire intermediate transfer belt 5 has a black color, the marking M can naturally be realized by roughing the surface thereof.

Figure 9:
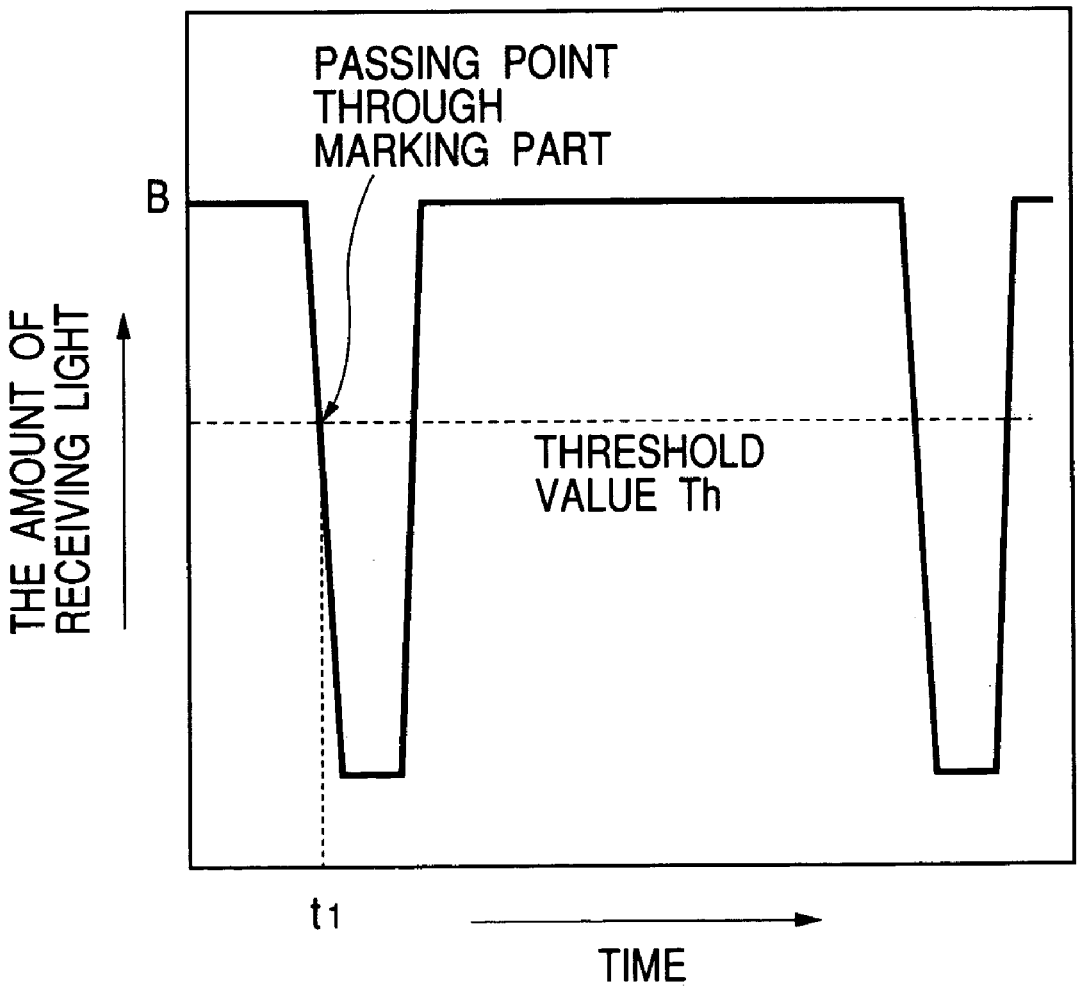
FIG. 9 is a timing chart showing a change in a received light amount at a position detection of a marking by the optical detection means.
Figure 10:
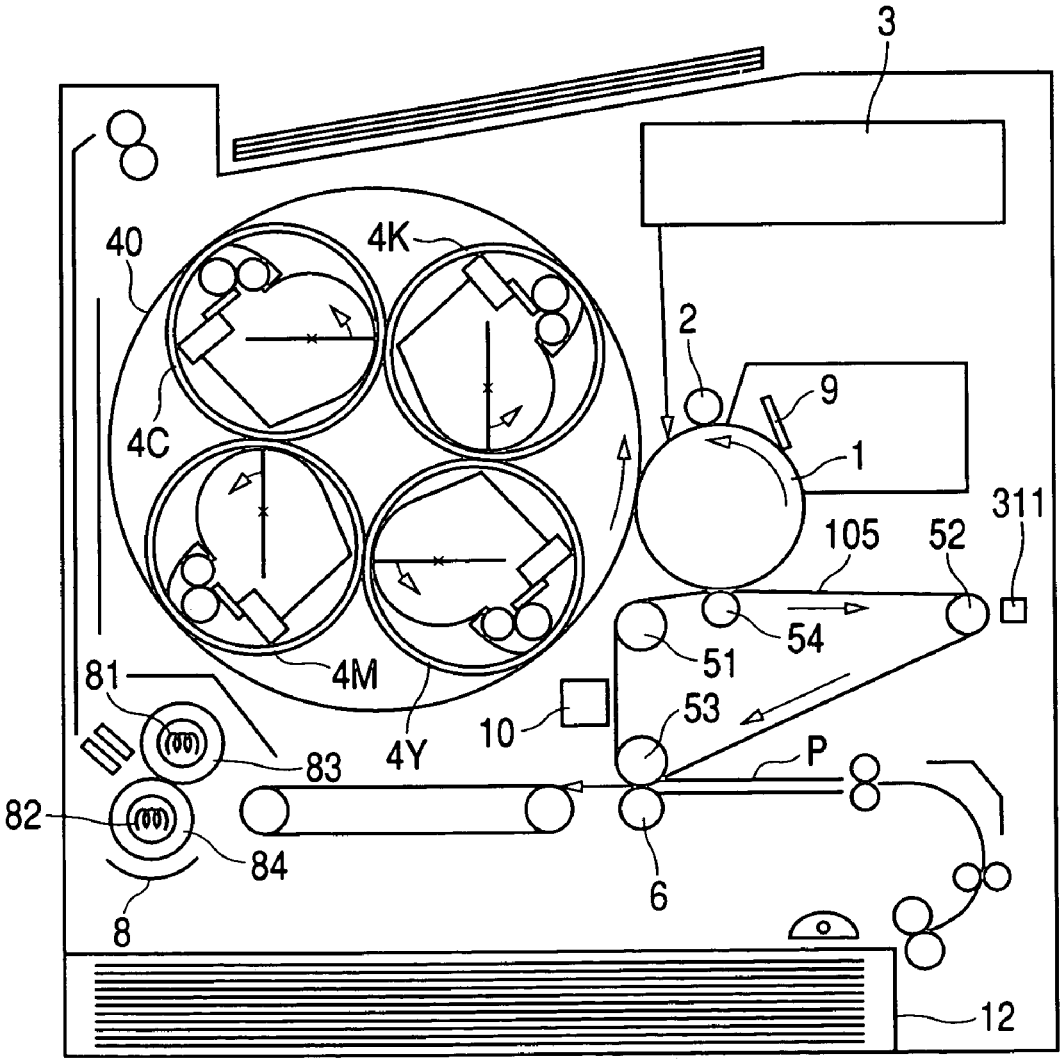
FIG. 10 is a view showing an image forming apparatus constituting a background technology of the present invention.

By providing the intermediate transfer belt 5 with such marking M and irradiating it with a light from the light-emitting means of the optical detection means 411, the reflected light is received sufficiently in a non-marking portion but is decreased in a blackened/surface-roughed marking portion, as shown in FIG. 9.

At a timing t1 when the light reception amount of the optical detection means 411 is decreased and becomes lower than a preset threshold value Th, the optical detection means 411 can judge a passing of a marking M, namely a passing of an image forming area, whereby a timing of image formation can be detected.

Also in order to stably maintain a base state B having a large light reception amount, the optical direction of the optical detection means 411 is aligned with a direction of a higher glossiness of the intermediate transfer belt 5 whereby it is rendered possible to realize a larger light reception amount even for a same belt and to improve a control precision of the timing of image formation.

More specifically, by matching the direction of higher glossiness of the intermediate transfer belt 5 and the optical direction of the optical detection means 411, it is rendered possible to increase a change in the light amount (dynamic amount) when a marking M of the intermediate transfer belt 5 is passed, whereby a freedom for setting the threshold value Th for judging whether the marking M has passed is further increased and, as a result, the timing of image formation can be detected more securely and precisely. In the present embodiment, the optical direction of the optical detection means 411 is made substantially same as the orienting direction of the crystalline structure of the belt 5, whereby the optical detection means 411 can be set in a direction capable of detecting the glossiness of the belt 5 at a relatively high level.

Also explained in the foregoing, also in the optical detection means for controlling the timing of image formation, it is possible to improve the ability for detecting the timing of image formation by matching the optical direction of the optical detection means and the direction of higher glossiness of the intermediate transfer belt, thereby achieving a precise control.

Also in the present embodiment, as explained in the foregoing embodiment, it is possible to improve the positional precision of the belt and the optical detection means by positioning the tension roller and the optical detection means in an opposed relationship.

The intermediate transfer belt is required to be satisfactory in a releasing property for the developer, a durability, a conveyability and a stability in manufacture. Polyimide (PI) is suitable as a material satisfying these properties, and enables formation of a high-quality image in more stable manner, by the application of the present invention.

However, a low cost is difficult to realize with PI because of a high material cost. Therefore, a resinous material employable as the intermediate transfer belt despite of inexpensiveness can be, for example, polycarbonate (PC), polyester, polyethylene terephthalate (PET), PES alloy, polyvinylidene fluoride (PVdF), ethylene-tetrafluoroethylene copolymer (ETFE), acrylonitrile-butadiene-styrene (ABS) etc.

However, PVdF or ABS, which is employed in the foregoing embodiments, is inferior to PI in the optical reflectance, which is about half in PVdF and ABS of that in PI.

Therefore, the present invention is particularly effective in case of employing, in the intermediate transfer belt, a material such as PVdF or ABS, which is more inexpensive but has a lower optical reflectance than PI.

A dimension, a material, a shape, a relative position etc. of a component of the image forming apparatus are not to limit the range of the present invention to such description unless otherwise specified.

Figure 11:
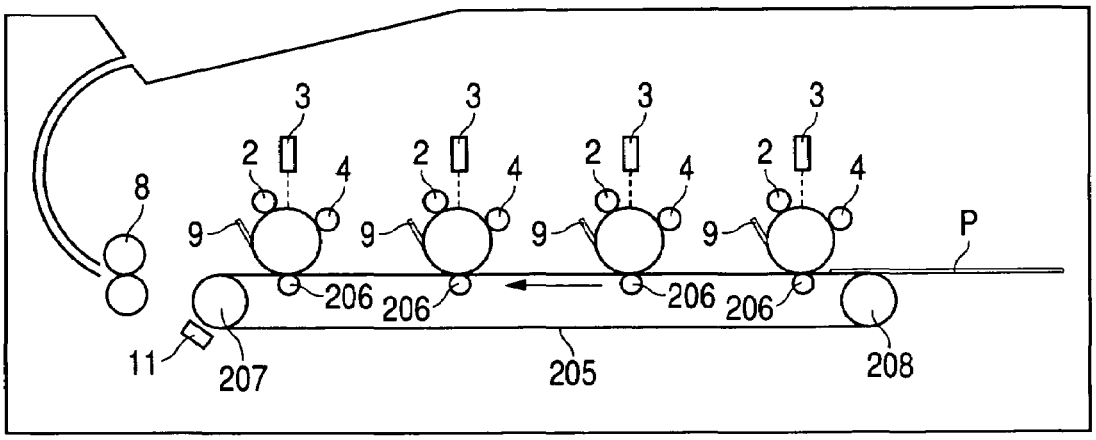
FIG. 11 is a view showing another image forming apparatus in which the present invention is applicable.

The belt in the foregoing embodiments is an intermediate transfer belt, but the present invention is also applicable to an image forming apparatus as shown in FIG. 11, in which toner image on plural photosensitive drums 1 are transferred and superposed in succession onto a transfer material P supported by a belt 205, thereby forming an image. In this case, the belt 205 is formed by drawing from a mold as in the case of the aforementioned intermediate transfer belt, and is subjected to a formation of a toner image for density detection or a formation of marking if necessary. It is effective, in case of detecting the toner image or the marking on the belt 205 for conveying the transfer material P, it is effective to apply the present invention and to position the optical direction of the optical detection means 11 substantially same as the drawing direction of the belt 205. In FIG. 11, there are shown developing means 4, transfer means 206 and tension rollers 207, 208 in which the roller 207 is opposed to the optical detection means 11 across the belt 205.

As explained in the foregoing, the image forming apparatus of the present invention is provided with an image bearing member for forming a developed image thereon, and optical detection means including light-emitting means for irradiating the surface of the image bearing member with a light and light-receiving means for receiving the light emitted from the light-emitting means and reflected by the surface of the image bearing member thereby detecting an optical intensity of the reflected light received by the light-receiving means, wherein the image bearing member is a belt having an anisotropy in a surface glossiness and an optical direction formed by the light-emitting means and the light-receiving means coincides with a direction of a higher surface glossiness of the surface of the image bearing member. Thus, utilizing the optical characteristics, namely the anisotropy in the glossiness, of the resinous belt resulting from the manufacturing method, the optical direction of the optical detection means is matched with the direction of the higher glossiness, thereby improving the precision of density detection of the developed image on the image bearing member by the optical detection means or improving the precision of detecting the position of a marking for adjusting the timing of image formation. It is thus rendered possible to constantly form a high-quality image stably even in the presence of an environmental change or a change in time of the photosensitive member or the developer, and to utilize a low-cost belt with a relatively low glossiness.

The present invention has been explained by embodiments thereof, but the present invention is not limited by such embodiments and is subject to any and all modifications within the technical concept of the present invention.

What is claimed is:

1. An image forming apparatus comprising:

an endless belt, wherein said belt has a first glossiness in a first direction and a second glossiness lower than the first glossiness in a second direction, and said belt is manufactured by a drawing from a mold, and the first direction is a drawing direction of said belt; and an optical detection device including a light-emitting portion and a light-receiving portion, wherein a light emitted from the light-emitting portion is reflected by said belt and is received by the light-receiving portion, and wherein an optical direction from the light-emitting portion to the light-receiving portion is substantially the same as the first direction of said belt.

2. An image forming apparatus according to claim 1, wherein said belt bears a toner image, and said optical detection device detects a toner density on said belt.

3. An image forming apparatus according to claim 2, wherein the toner image is an image for density detection.

4. An image forming apparatus according to claim 1, wherein said optical detection device detects a mark on said belt.

5. An image forming apparatus according to claim 1, wherein said belt moves rotationally, and the first direction is perpendicular to a moving direction of said belt.

6. An image forming apparatus according to claim 1, further comprising a support member for supporting said belt, wherein said optical detection device is opposed to the support member across said belt.

7. An image forming apparatus according to claim 1, wherein said belt is an intermediate transfer member.

8. An image forming apparatus according to claim 1, wherein said belt is a transfer material bearing member.

9. An image forming apparatus according to claim 1, wherein an image forming condition for forming a toner image is controlled according to an output of said optical detection device.

* * * * *